United States Patent [19]

Carpenter et al.

[11] Patent Number: 4,471,583

[45] Date of Patent: Sep. 18, 1984

[54] VANE RETENTION APPARATUS FOR ABRASIVE BLASTING MECHANISM

[75] Inventors: James H. Carpenter; Donald G. Corderman, both of Hagerstown, Md.

[73] Assignee: The Kennecott Corporation, Cleveland, Ohio

[21] Appl. No.: 481,919

[22] Filed: Jun. 6, 1983

Related U.S. Application Data

[62] Division of Ser. No. 245,028, Mar. 18, 1981, Pat. No. 4402163.

[51] Int. Cl.[3] ..... B24C 5/06

[52] U.S. Cl. ..... 51/434

[58] Field of Search ..... 51/434, 435, 431, 432; 241/275

[56] References Cited

U.S. PATENT DOCUMENTS

| | | | |
|---|---|---|---|
| 2,119,812 | 6/1938 | Hamren | 51/434 |
| 2,369,408 | 2/1945 | Rosenberger | 51/432 |
| 2,869,289 | 1/1959 | Gossard | 51/434 |
| 3,241,266 | 3/1966 | Bowling, Jr. | 51/435 X |
| 3,383,804 | 5/1968 | Haider | 51/434 |
| 3,872,624 | 3/1975 | Ramaswamy | 51/435 |
| 3,945,150 | 3/1976 | Beckner | 51/434 |

*Primary Examiner*—Frederick R. Schmidt
*Assistant Examiner*—Robert A. Rose
*Attorney, Agent, or Firm*—R. Lawrence Sahr

[57] ABSTRACT

This relates to the mounting of vanes on a runnerhead of an abrasive blasting machine. The face of the runnerhead is provided with slots in which bases of vanes are slid in a generally radial direction with the base having an interlock with the runnerhead so as to retain the vane against movement normal to the face of the runnerhead. This particularly has to do with the locking of the vane base in the runnerhead slot. The pin is rectangular as opposed to the usual circular pin and the outer ends of the runnerhead slot and vane base are provided with cooperating slots and grooves which receive the pin, the pin being inserted in a first groove and slot arrangement at an angle to the axis of the base and then rotated or pivoted into a second groove and slot arrangement where it is locked in place against retrieval. The pin is locked in place by the outward movement of the vane from its pin inserting position. The machine has a safety feature in that when the vane is in the pin receiving position, the inner end thereof will engage a lug cast on the outside of the impeller case so as to prevent rotation of the runnerhead.

12 Claims, 12 Drawing Figures

VANE RETENTION APPARATUS FOR ABRASIVE BLASTING MECHANISM

This is a division of application Ser. No. 245,028 filed Mar. 18, 1981, now U.S. Pat. No. 4,402,163.

This invention relates in general to new and useful improvements in abrasive blasting machines of the type including a runnerhead having an exposed face provided with a plurality of generally radiating vanes. This invention constitutes an improvement with respect to U.S. Pat. No. 3,872,624 and like blasting machines.

In earlier blasting machine wheel constructions, it was possible to remove a vane without removing the feed parts, i.e. feed spout, impeller, impeller case and deflector. This was possible because the pin attachment for retaining a vane on the runnerhead was restricted to one pin installed perpendicular to the runnerhead on the back side of the vane. Removal of this pin could be accomplished without vane movement. After the pin was removed, the vane was pulled radially out of the runnerhead.

In other constructions, double runnerheads are provided and the vanes slide into slots in the double runnerheads from the center of the wheel and are held in place by a spacer bar which extends between and supports the runnerheads. This arrangement requires removal of all feed parts as well as removal of the vanes out through the feed spout opening.

In yet other arrangements, which are less popular, the vanes are bolted to the runnerhead. Another method of securing vanes to the runnerhead is that disclosed in the above-mentioned U.S. Pat. No. 3,872,624. In this arrangement the retaining pin is moved from the back of the vane to the bottom outer edge of the vane base. In this position, the pin tends to hold the vane vertically in the runnerhead slot. This is necessary because a tilting force acts on the vane. The force is created because the vane sits at an angle off of a radial line from the center of rotation of the runnerhead. While this design is fail safe and holds the vane vertical, it requires (1) removal of feed parts, (2) movement of the vane forward to release the pin, (3) pin removal and (4) removal of the vane.

In accordance with this invention, it is proposed to provide a vane retention apparatus which provides for the ease of removal of vanes and eliminates the need for removal of feed parts, impeller, case, etc. In accordance with this invention, a rectangular pin instead of the usual round pin is utilized, giving additional aid in holding a vane vertical to the runnerhead. The rectangular pin places the pin pull-out hole always in the same position for easy insertion for a pin puller hook as opposed to the possibility that the pull-out hole may be in any position with a round pin.

The use of a rectangular pin, for a given size pin recess, gives a larger shear area for retaining the vane and thus a greater safety factor. In addition, the pin recess in the runnerhead is simpler to machine.

Yet another feature of the invention is the provision of lugs on the impeller case which forces the vane assembler to lock the pin in place before he can rotate the wheel to the next vane insertion position.

With the above, and other objects in view that will hereinafter appear, the nature of the invention will be more clearly understood by reference to the following detailed description, the appended claims and the several views illustrated in the accompanying drawings.

Figure 1:
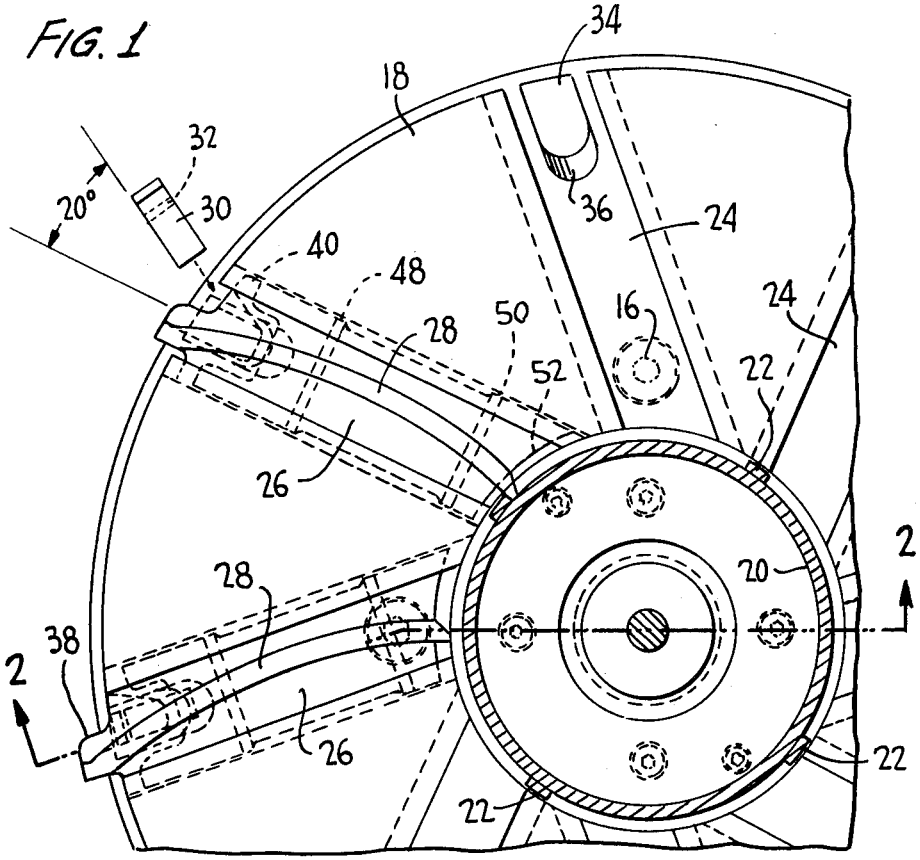
FIG. 1 is a fragmentary sectional view through an abrasive blasting machine with the runnerhead being shown in elevation and one vane in place and a second vane being positioned, the view being taken generally along the line 1—1 of FIG. 2.
Figure 2:
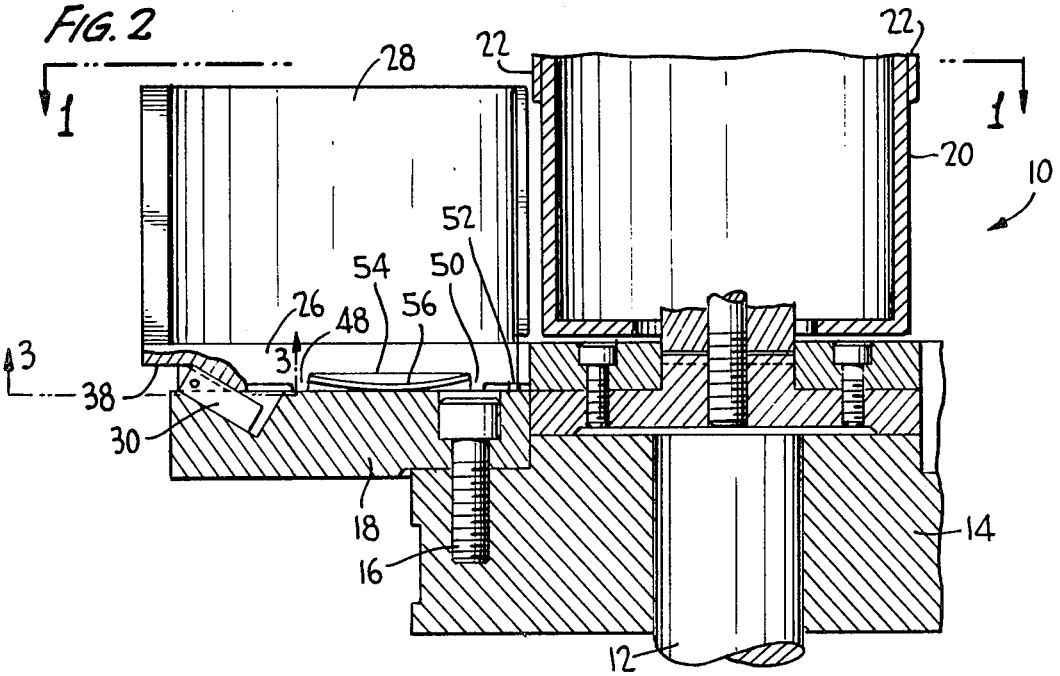
FIG. 2 is a transverse sectional view taken along the line 2—2 of FIG. 1.

Referring now to the drawings in detail, it will be seen that there is illustrated in FIGS. 1 and 2 components of an abrasive blasting machine in which the vane mounting arrangement of this invention is incorporated. The machine is generally identified by the numeral 10 and includes a shaft 12 which has fixedly mounted thereon for rotation therewith a hub 14. The hub has secured thereto by bolts 16 a runnerhead 18.

The apparatus 10 also includes an impeller case 20 which is fixed. The impeller case 20 is spaced from the hub 14 and is provided about the periphery thereof with short lugs 22 to be described hereinafter.

As will be readily apparent from FIG. 1, the face of the runnerhead 18 has formed therein a plurality of slots 24 which may be of a suitable dovetail or other undercut configuration. It is to be noted that the slots 24 are disposed at an angle to a radial line.

It is intended that each slot 24 receives a base 26 of a curved vane 28 with the base 26 being inserted into the slot 24 and removed therefrom from the exterior of the runnerhead. Once the base 26 is inserted in an associated slot, it is retained therein by a pin 30. The specific pin 30 and the mounting thereof in interlocking engagement between the runnerhead 18 and the vane base 26 constitute the principal features of this invention.

First of all, the pin 30 is of a rectangular cross section as opposed to the customary circular cross section previously used. The pin 30 is provided with a transverse bore 32 into which a suitable removal tool may be engaged to effect the pulling thereof.

At the base of each of the slots 24 and adjacent the outer periphery of the runnerhead 18, as is clearly shown in FIGS. 1 and 2, there is a further slot 34 for receiving the pin 30. The slot 34 is rectangular in cross section and of a width greater than that of the pin 30. It will be seen from FIG. 2 that the slot increases in depth from a zero depth at its outer end to a maximum depth at its inner end and that the slot 34 is of a rounded configuration 36 at its inner end. The slot 34 thus may be made by a suitable rotary milling tool.

Figure 8:
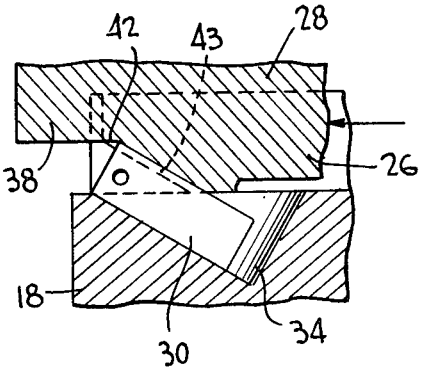
FIG. 8 is a sectional view taken along the line 8—8 of FIG. 7.

At this time it is pointed out that the vane 28 extends radially outwardly beyond the major portion of the base 26 and that the base 26 has a projection 38 which extends radially outwardly of the runnerhead when the vane is in its properly seated position, as is clearly shown in FIG. 8.

Figure 3:
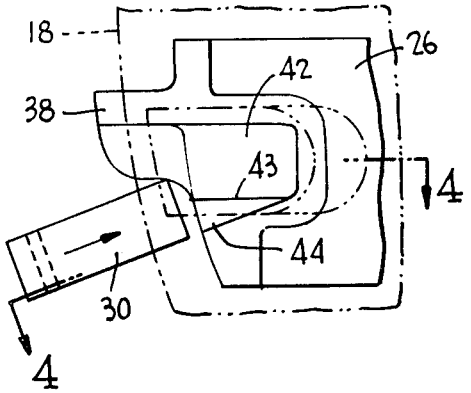
FIG. 3 is an enlarged fragmentary sectional view taken along the line 3—3 of FIG. 2 of the underface of the vane and illustrating the runnerhead and pin slot in phantom lines, and a pin in position for insertion.
Figure 5:
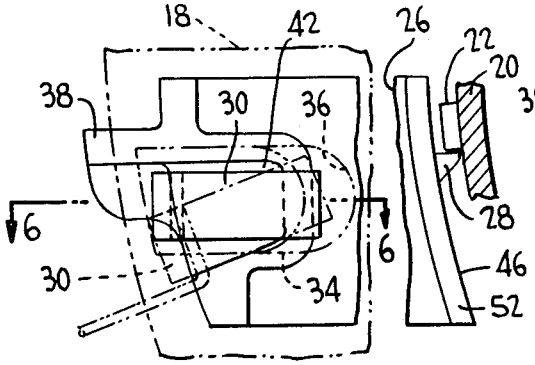
FIG. 5 is an enlarged fragmentary sectional view similar to FIG. 3 but illustrating the pin cammed into its locking position, there also being illustrated in dot-dash lines the pin and its puller in the position they would assume for withdrawal.
Figure 6:
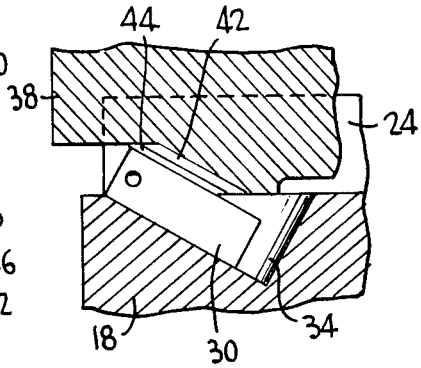
FIG. 6 is a sectional view taken along the line 6—6 of FIG. 5.
Figure 7:
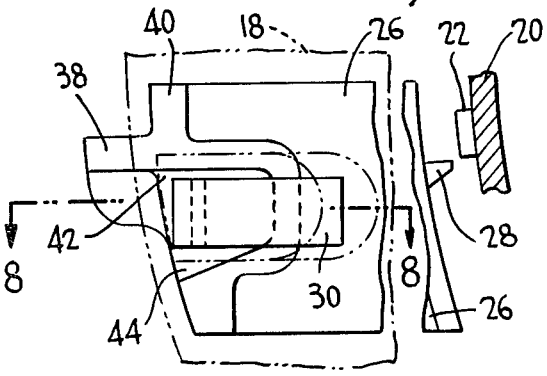
FIG. 7 is another enlarged fragmentary sectional view similar to FIG. 3 but showing the vane withdrawal from contact with the impeller case and in its operative position.

It is also to be noted from FIGS. 3, 5 and 7 that the underside of the base 26 has a generally U-shaped depending support surface 40 at the outer end thereof. Into this supporting surface there are formed two grooves arranged on different levels. The first and deepest of these grooves is identified by the numeral 42 and it is generally centered on the axis of the base 26, as is best shown in FIG. 3. A second groove, 44, extends into the base from the outer end thereof at an angle on the order of 20° and is separated from the groove 42 by a shoulder 43. It is to be noted that the grooves 42, 44 slope downwardly and inwardly at the same angle as the slot 34. It is further to be noted that the spacing of the upper surface of the groove 42 and the lower surface of the slot 34 correspond generally to the thickness of the pin 30 when the vane 28 is in its operating position, as is shown in FIG. 8, and that when the vane 28 is in its innermost position, as shown in FIG. 6, the spacing between the upper surface of the groove 44 and the lower surface of the slot 34 is greater than that of the thickness of the pin 30.

With reference to FIG. 5, in particular, it will be also seen that the base 26 has a curved inner surface 46 which is disposed concentric with the outer surface of the impeller case 20. Further, it will be seen that the inner end of the vane 28 projects radially inwardly beyond the curved surface 46.

Figure 4:
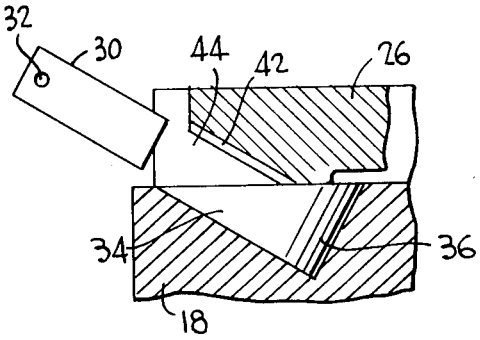
FIG. 4 is a sectional view taken along the line 4—4 of FIG. 3.

Referring now to FIGS. 3–8, it will be seen that when a vane 28 is to be installed, the base 26 is slid into its respective groove until the inner end of the vane 28 strikes the outer surface of the impeller case 20. At this time the spacing between the remote surfaces of the groove 44 and the slot 34 permits the insertion of the pin 30, as is shown in FIGS. 3 and 4. When the pin 30 is fully seated, as is shown in phantom lines in FIG. 5, due to the rounded inner end 36 of the slot 34, the pin 30 may be readily rotated in the direction of the arrow in FIG. 5 to its seated full line position. It is now aligned with the groove 42.

As is clearly shown in FIG. 5, the vane 28 must now be withdrawn, otherwise when the runnerhead 18 is rotated, the inner tip of the vane 28 will engage one of the lugs 22. When the vane 28 is withdrawn in an outward radial direction, as shown in FIG. 7, the pin 30 becomes fully seated in the groove 42 and the slot 34 as is clearly illustrated in FIG. 8. The vane 28 is now prevented from moving further radially outwardly during the operation of the apparatus.

It is also to be noted that the overhang 38, into which the groove 42 merges, functions as a slot to prevent the accidental outward movement of the pin 30 and shoulder 43 prevents sidewise movement after the vane is pulled out into its running position. Thus the pin 30 is firmly locked in place while it firmly locks the vane in place.

When it is desired to replace the vane 28, it is merely necessary to first move the vane radially inwardly until it engages the impeller case 20, as shown in FIG. 5. Then utilizing a conventional tool 47 and engaging it in the hole 32 and the pin 30, the pin 30 is first rotated out of alignment with the groove 42 into alignment with the groove 44, after which it may be radially withdrawn, thereby freeing the vane 28 for removal.

No other components of the apparatus need be disassembled in order to effect the removal and replacement of the vane.

With reference to FIG. 2, it is also pointed out here that the underside of the base 26 is provided with other support surfaces 48, 50 and 52 which are radially spaced along the length of the base 26. In addition, the underside of the base 26 may be provided with a groove 54 between the support surfaces 48 and 50 and in this groove may be seated a suitable leaf spring 56 which will bear against the runnerhead 18 and cam the base 26 away from the runnerhead 18 so as to firmly seat the base 26 in the slot 24.

Referring now to FIGS. 9 through 12, it will be seen that there is illustrated a modified form of retaining pin receiving groove which is generally identified by the numeral 60. The groove 60 is of a two level construction and includes a primary groove portion 62 which tapers from a maximum depth at its outer end to zero depth at its inner end. The primary groove portion 62 includes a generally rectangular inner part 64 and an entrance part 66 which is angularly disposed with respect to the inner part 64.

The groove 60 also includes a secondary portion 68 which is aligned with the primary groove 62. It is to be understood that the secondary groove 68 is relatively narrow and is primarily disposed to one side of the entrance part 66 of the primary groove portion. The secondary groove portion 68 has a top wall which is generally parallel to the support surface 40 and is generally coplanar with the underside of the vane 28. It thus will be seen that the top wall of the secondary groove portion 68 intersects and terminates in the top wall of the primary groove portion 62 into each of the ends of the top wall of the groove portion 62 generally as at 70.

Figure 9:
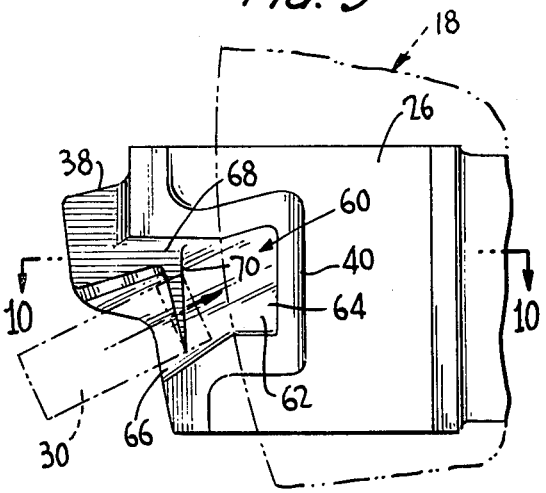
FIG. 9 is a fragmentary plan view of the underface of a vane having a modified pin groove.
Figure 10:
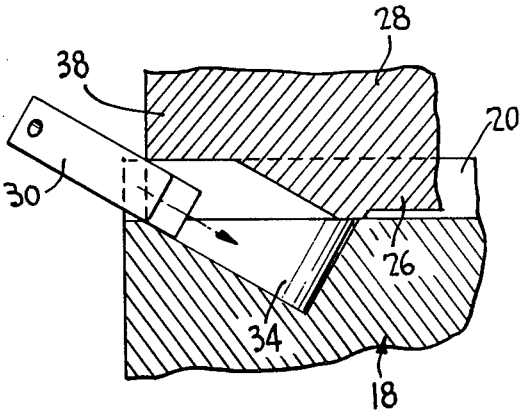
FIG. 10 is a sectional view taken generally along the line 10—10 of FIG. 9 and shows the relationship of the pin groove of the vane with respect to the pin slot of the runnerhead when the vane is in a position for receiving the retaining pin.
Figure 11:
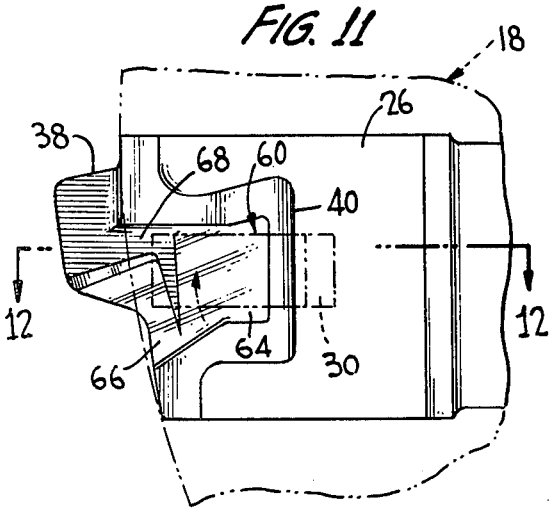
FIG. 11 is a view similar to FIG. 9 showing the retaining pin in place in dotted lines and the vane retracted radially outwardly relative to the runnerhead.
Figure 12:
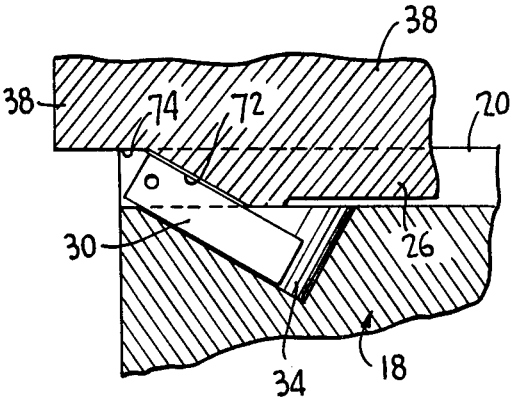
FIG. 12 is a vertical sectional view taken generally along the line 12—12 of FIG. 11 and shows specifically the position of the retaining pin in position locking the vane against radial outward movement.

When the vane is in its innermost position, a locking pin 30 may be freely inserted into the primary groove portion 62 by passing it through the entrance part 66 and down into the slot 34, generally as is shown in FIGS. 9 and 10. When the retaining pin 30 is in its fully inserted position, it is then shifted out of alignment with the entrance part 66 and into alignment with the secondary groove portion 68, as is shown in FIG. 11. The retaining pin 30 is now in a vane retaining position and the vane is pulled outwardly until the retaining pin 30 is wedged between the sloping top wall 72 of the inner part of the primary groove portion 62 and the bottom wall of the slot 34, as is shown in FIG. 12. At this time the retaining pin 30 is strapped in position by the top wall of the secondary groove portion 68, which top wall is identified by the reference numeral 74. The vane is thus retained in place until it is again shifted radially inwardly and the pin 30 twisted to a position aligned with the entrance part 66 for removal. On the other hand, the entrance part 66 provides access to the retaining pin 30 to effect the removal thereof.

Although only a preferred embodiment of the invention has been specifically illustrated and described herein, it is to be understood that minor variations may be made in the mounting of the vane without departing from the spirit and scope of the invention as defined by the appended claims.

We claim:

1. A runnerhead and vane assembly of a blast wheel, said runnerhead having an exposed face with a plurality of generally radiating vane receiving slots therein, each slot having a base and side walls; the improvement residing in a vane retaining pin receiving slot in each vane receiving slot base adjacent the radial outer end thereof, said pin receiving slot sloping away from said face and radially inwardly and terminating at the radially inner end thereof in an end wall forming means for facilitating the pivoting and centering of an intended retaining pin, a blast wheel vane mounted in each of said slots, each blast wheel vane including a mounting base seated in a respective vane receiving slot and a projecting vane element, said base having inner and outer end portions, a retaining pin receiving groove in the underside of said base outer end portion, a retaining pin partially seated in both said pin receiving slot and said groove with said base preventing withdrawal of said pin and said pin preventing withdrawal of said blast wheel vane, and said groove having one side edge extending substantially longitudinally of said base and another side edge extending generally longitudinally of but sloping relative to the longitudinal extent of said base with that portion of said groove adjacent said another side edge being an access area for a retaining pin and that portion of said groove adjacent said one side edge being a retaining area for said retaining pin.

2. The assembly of claim 1 wherein said pin slopes and has an inner end fully within said runnerhead pin slot and an outer end substantially fully within said blast wheel vane groove.

3. The assembly of claim 1 wherein said pin slot and said pin are both of a rectangular cross section and said pin slot is of a width materially greater than the width of said pin to permit pivoting of said pin in said pin slot from an insertion position to a blast wheel vane retaining position.

4. The assembly of claim 3 wherein said pin slot is of a maximum depth greater than the thickness of said pin.

5. The assembly of claim 1 wherein an adjacent portion of said vane element directly overlies a part of said retaining area.

6. The assembly of claim 1 wherein said groove slopes inwardly and away from said vane element to a zero depth.

7. The assembly of claim 1 wherein said base outer edge end portion includes an outwardly directed part of a reduced thickness and width, said outwardly directed part being aligned with only a portion of said groove to further define said access area into said groove and to define a pin stop.

8. The assembly of claim 7 wherein said vane element has an outer end portion overlying said outwardly directed part.

9. A runnerhead and vane assembly of a blast wheel, said runnerhead having an exposed face with a plurality of generally radiating vane receiving slots therein, each slot having a base and side walls; the improvement residing in a vane retaining pin receiving slot in each vane receiving slot base adjacent the radial outer end thereof, said pin receiving slot sloping away from said face and radially inwardly and terminating at the radially inner end thereof in an end wall forming means for facilitating the pivoting and centering of an intended retaining pin, a blast wheel vane mounted in each of said slots, each blast wheel vane including a mounting base seated in a respective vane receiving slot and a projecting vane element, said base having inner and outer end portions, a retaining pin receiving groove in the underside of said base outer end portion, and a retaining pin partially seated in both said pin slot and said groove with said base preventing withdrawal of said pin and said pin preventing withdrawal of said blast wheel vane, said groove being of a two level construction including a pin positioning level and a pin retaining level, said levels being in side by side relation and separated by a shoulder for engaging and locking a retaining pin in alignment with said pin retaining level.

10. The assembly of claim 9 wherein said groove includes a primary groove portion and a secondary groove portion, said groove portions having upper walls lying in different planes.

11. The assembly of claim 9 wherein at an inner end of each vane said vane element projects inwardly beyond said base, and said base inner end is disposed outwardly of the inner end of the respective runnerhead slot in the operative position of said vane whereby each vane may be shifted inwardly in its respective runnerhead slot to permit the insertion and removal of its retaining pin.

12. A runnerhead and vane assembly of a blast wheel, said runnerhead having an exposed face with a plurality of generally radiating vane receiving slots therein, each slot having a base and side walls; the improvement residing in a vane retaining pin receiving slot in each vane receiving slot base adjacent the radial outer end thereof, said pin receiving slot sloping away from said face and radially inwardly and terminating at the radially inner end thereof in an end wall forming means for facilitating the pivoting and centering of an intended retaining pin, a blast wheel vane mounted in each of said slots, each blast wheel vane including a mounting base seated in a respective vane receiving slot and a projecting vane element, said base having inner and outer end portions, a retaining pin receiving groove in the underside of said base outer end portion, a retaining pin partially seated in both said pin receiving slot and said groove with said base preventing withdrawal of said pin and said pin preventing withdrawal of said blast wheel vane, and a fixed impeller case having an end opposing said runnerhead and a generally cylindrical exterior surface disposed generally within inner ends of said blast wheel vanes and facing said inner ends, said case having at least one radially outwardly projecting lug, said lug being in circumferentially overlapping relation with inner ends of said vane elements when said blast wheel vanes are in radially inner released positions said lug forming stop means to prevent operation of said blast wheel with a blast wheel vane in a released position.

* * * * *